US009470080B2

(12) United States Patent
Kommepalli et al.

(10) Patent No.: US 9,470,080 B2
(45) Date of Patent: Oct. 18, 2016

(54) METHOD AND SYSTEM FOR RECOVERING OIL FROM AN OIL-BEARING FORMATION

(71) Applicant: General Electric Company, Schenectady, NY (US)

(72) Inventors: Hareesh Kumar Reddy Kommepalli, Albany, NY (US); Andrew Philip Shapiro, Schenectady, NY (US); Todd Alan Anderson, Niskayuna, NY (US); Hua Wang, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 260 days.

(21) Appl. No.: 14/205,514

(22) Filed: Mar. 12, 2014

(65) Prior Publication Data

US 2015/0260028 A1 Sep. 17, 2015

(51) Int. Cl.

*E21B 43/40* (2006.01)
*E21B 43/16* (2006.01)
*E21B 43/38* (2006.01)

(52) U.S. Cl.

CPC ..... *E21B 43/40* (2013.01); *E21B 43/16* (2013.01); *E21B 43/385* (2013.01)

(58) Field of Classification Search

CPC ..... E21B 43/40; E21B 43/385; E21B 36/00; E21B 36/008; E21B 43/24; E21B 43/16; E21B 43/20; B01D 61/027

See application file for complete search history.

(56) References Cited

U.S. PATENT DOCUMENTS 4,397,661 A 8/1983 King et al.
6,303,037 B1 10/2001 Tamura et al.
7,368,058 B2 5/2008 Nishikawa et al.
7,410,581 B2 8/2008 Arnold et al.
7,455,109 B2 11/2008 Collins
7,600,567 B2 10/2009 Christopher et al.
7,726,398 B2 6/2010 Collins et al.
7,901,578 B2 3/2011 Pruet (Continued)

FOREIGN PATENT DOCUMENTS

WO 2007138327 A1 12/2007
WO 2007144591 A1 12/2007

(Continued)

OTHER PUBLICATIONS

Hoof et al., "Dead-end Ultrafiltration as Alternative Pre-treatment to Reverse osmosis in Seawater Desalination: a Case study", Desalination, Sep. 20, 2001, vol. 139, Issue 1-3, pp. 161-168.

(Continued)

*Primary Examiner* — Yong-Suk (Philip) Ro
(74) *Attorney, Agent, or Firm* — Francis T. Coppa

(57) ABSTRACT

A system and a method for recovering oil from an oil-bearing formation wherein the method includes providing a reverse osmosis (RO) unit comprising at least one membrane; feeding a first feed stream having a first salinity content to a first side of the membrane; and feeding a second feed stream having a second salinity content to a second side of the membrane. The method further includes discharging a retentate stream from the first side of the membrane, and discharging a product stream having a controlled salinity content from the second side of the membrane. The method furthermore includes injecting at least a portion of the product stream into the oil-bearing formation, and recovering at least a portion of the oil from the oil-bearing formation.

20 Claims, 3 Drawing Sheets

(56) References Cited

U.S. PATENT DOCUMENTS

| | | | | |
|---|---|---|---|---|
| 7,972,514 | B2 | 7/2011 | Thorsen et al. | |
| 8,083,948 | B2 | 12/2011 | Ito et al. | |
| 8,439,111 | B2 | 5/2013 | Collins et al. | |
| 2007/0246426 | A1 | 10/2007 | Collins | |
| 2009/0039020 | A1 | 2/2009 | Wilf et al. | |
| 2011/0005749 | A1* | 1/2011 | Curole | B01D 61/027 166/272.3 |
| 2012/0006749 | A1 | 1/2012 | Said | |
| 2012/0145635 | A1 | 6/2012 | Lucas et al. | |
| 2012/0261340 | A1 | 10/2012 | Williams | |
| 2012/0325745 | A1 | 12/2012 | Bossler et al. | |

FOREIGN PATENT DOCUMENTS

| | | | |
|---|---|---|---|
| WO | 2010151574 | A3 | 3/2011 |
| WO | 2011051666 | A1 | 5/2011 |
| WO | 2011086346 | A1 | 7/2011 |
| WO | 2011100136 | A1 | 8/2011 |
| WO | 2013012548 | A1 | 1/2013 |
| WO | 2013049572 | A1 | 4/2013 |

OTHER PUBLICATIONS

Webb et al., "Low Salinity Oil Recovery—Log-Inject-Log", Apr. 17-21, 2004, Location: Tulsa, Oklahoma, 7 Pages.

Pellegrino et al., "A Speculative Hybrid Reverse Osmosis/Electrodialysis Unit Operation", Desalination, Aug. 15, 2007, vol. 214, Issue 1-3, pp. 11-30.

Ayirala, "A Designer Water Process for Offshore Low Salinity and Polymer Flooding Applications", SPE Improved Oil Recovery Symposium, Apr. 24-28, 2010, Location: Tulsa, Oklahoma, 12 pages.

* cited by examiner

METHOD AND SYSTEM FOR RECOVERING OIL FROM AN OIL-BEARING FORMATION

BACKGROUND OF THE INVENTION

The invention relates generally to a method and system for recovering oil from an oil-bearing formation. More particularly, the invention relates to a method and system for recovering oil from an oil-bearing formation by injecting a water stream having controlled salinity content.

Low salinity water is typically injected into an oil bearing reservoir in order to enhance the oil recovery from such reservoirs. The enhanced oil recovery is typically effected due to an increase in wettability of the rock matrix, thereby, releasing extra oil from the reservoir. However, one of the challenges associated with this method is that currently available desalination techniques yield water of a salinity that may be lower than the optimal salinity for enhanced oil recovery. In fact, the desalinated water produced by such techniques may actually be damaging to the reservoir and inhibit oil recovery, for example by causing swelling of clays. Thus, there is an optimal salinity for the injection water that provides the benefit of enhanced oil recovery while avoiding formation damage, and, the optimum value may vary from formation to formation.

Typical methods of optimizing the salinity of the water stream include blending the low salinity water stream with a water stream of high salinity (for example, sea water). However, it may not be desirable to mix a desalinated water of low multivalent cation content with a high salinity water (such as seawater), because of the high sulfate anion content and/or the high multivalent cation content of sea water. The high sulfate anion content of such blended water streams may result in reservoir souring and/or the precipitation of unacceptable levels of insoluble mineral salts (scale formation). Further, the presence of multivalent ions in the water above a certain concentration level may also have negative effects, such as, precipitation of surfactants.

Some other methods of optimizing the salinity content include splitting the seawater stream into two water feed streams and utilizing two filtration processes: reverse osmosis (RO) and nano-filtration (NF), followed by blending of the two treated streams down-stream of the RO unit. Such systems and processes, however, may have the drawbacks of one or more of higher energy requirements, a larger system footprint, higher complexity of controls, and higher complexity of operation. Forward osmosis (FO) is another method sometimes utilized to generate water stream with controlled salinity content. However, the FO process uses a draw solute to artificially increase salinity on the permeate side, and thus requires a chemical system to remove the draw solute before discharging the permeate.

Thus, there is a need for improved methods and systems for producing water streams having controlled salinity content, which is suitable for injection into an oil-bearing formation. Further, there is a need for improved methods and systems for recovering oil from an oil-bearing formation by injecting a water stream having the controlled salinity content.

BRIEF DESCRIPTION OF THE INVENTION

One embodiment is directed to a method for recovering oil from an oil-bearing formation, comprising:

(i) providing a reverse osmosis (RO) unit comprising at least one membrane;

(ii) feeding a first feed stream having a first salinity content to a first side of the membrane;

(iii) feeding a second feed stream having a second salinity content to a second side of the membrane;

(iv) discharging a retentate stream from the first side of the membrane;

(v) discharging a product stream having a controlled salinity content from the second side of the membrane;

(vi) injecting at least a portion of the product stream into the oil-bearing formation; and (vii) recovering at least a portion of the oil from the oil-bearing formation.

Another embodiment of the invention is directed to a method for recovering oil from an oil-bearing formation, comprising:

(i) providing a reverse osmosis (RO) unit comprising at least one membrane;

(ii) generating a feed stream from a pre-treatment unit and splitting the feed stream into a first feed stream having a first salinity content and a second feed stream having a second salinity content;

(iii) feeding the first feed stream to a first side of the membrane and feeding the second feed stream to a second side of the membrane;

(iv) discharging a retentate stream from the first side of the membrane;

(v) discharging a product stream having a controlled salinity content from the second side of the membrane, wherein the salinity content of the product stream is controlled by adjusting one or both of the flow rate of the first feed stream and the flow rate of the second feed stream;

(vi) injecting at least a portion of the product stream into the oil-bearing formation; and (vii) recovering at least a portion of the oil from the oil-bearing formation.

Another embodiment of the invention is directed to a system for recovering oil from an oil-bearing formation, comprising a desalination apparatus for producing a product stream with a controlled salinity content, the desalination apparatus comprising at least one reverse osmosis (RO) unit, comprising:

(a) at least one RO membrane;

(b) a first inlet configured to receive a first feed stream having a first salinity content on a first side of the membrane;

(c) a second inlet configured to receive a second feed stream having a second salinity content on a second side of the membrane;

(d) a first discharge outlet configured to discharge a retentate stream from the first side of the membrane; and (e) a second discharge outlet configured to discharge a product stream having the controlled salinity content from the second side of the membrane, wherein the second discharge outlet is fluidly connected to an injection unit that is configured to inject at least a portion of the product stream to the oil-bearing formation.

DRAWINGS

These and other features, aspects, and advantages of the present invention will become better understood when the following detailed description is read with reference to the accompanying drawings, in which like characters represent like parts throughout the drawings, wherein.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Approximating language, as used herein throughout the specification and claims, may be applied to modify any quantitative representation that could permissibly vary without resulting in a change in the basic function to which it is related. Accordingly, a value modified by a term or terms, such as "about", is not limited to the precise value specified. In some instances, the approximating language may correspond to the precision of an instrument for measuring the value.

In the following specification and claims, the singular forms "a", "an" and "the" include plural referents unless the context clearly dictates otherwise. As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances, the modified term may sometimes not be appropriate, capable, or suitable.

Figure 1:
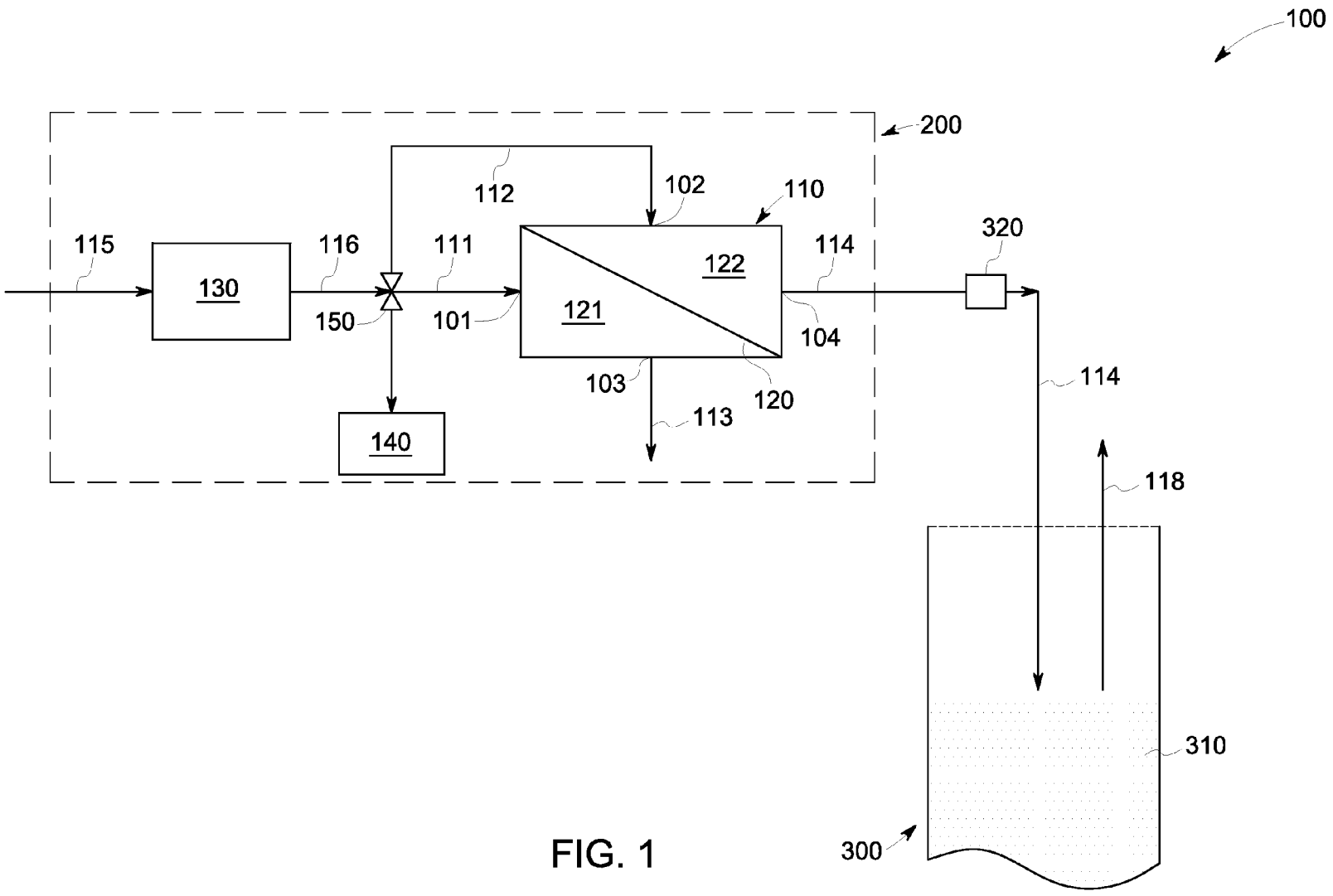
FIG. 1 illustrates a schematic of a system for recovering oil from an oil-bearing formation, according to an embodiment of the invention.

FIG. 1 schematically represents a system 100 and related method for recovering oil from an oil-bearing formation as per one embodiment of the present invention. The method includes providing a reverse osmosis (RO) unit 110 including at least one RO membrane 120. The method includes feeding a first feed stream 111 having a first salinity content to a first side 121 of the membrane 120; and feeding a second feed stream 112 having a second salinity content to a second side 122 of the membrane 120, as shown in FIG. 1. The method further includes discharging a retentate stream 113 from the first side 121 of the membrane 120, and discharging a product stream 114 having a controlled salinity content from the second side 122 of the membrane 120.

The RO membrane 120 may be a semi-permeable membrane such that the membrane does not allow large molecules or ions to pass through the pores of the membrane, but allows small molecules (such as, water to pass through). The terms "RO membrane" and "membrane" are used herein interchangeably for the sake of brevity.

Suitable non-limiting examples of membrane 120 include certain organic membranes (for example, polymeric membranes); inorganic membranes (for example, metallic, silica, ceramic, carbon, zeolite, oxide or glass membranes); hybrid or mixed-matrix membranes comprised of inorganic particles (for example, zeolite, carbon, metal and metal oxides) as the dispersed phase and a polymer matrix as the continuous phase materials, and combinations thereof. In some embodiments, membrane 120 may be formed of a polymer, such as, for example, a homopolymer, a copolymer, a polymer blend, or combinations thereof.

The membrane 120 may have any known configuration suitable for application in the present invention. Examples of suitable membrane configurations, may depend, in part, on the membrane material, and may include, flat sheet, spiral wound, tubular, capillary, monolithic (multi-channel), coated, or hollow-fiber membrane. In certain embodiments, the membrane 120 may operate in a cross-flow mode, as further illustrated in FIG. 2.

Further, the membrane 120 may be positioned in a single RO unit (stage) 110 or in several units, wherein each unit may be comprised of one or more separate membranes 120. Typically, the number of RO units 110 may depend on the surface area of the separate membranes 120 in combination with the required quantity of water to be permeated. The plurality of RO units 110 (embodiment not shown), if present, may be arranged in series or in parallel. The membrane units may include RO membranes 120 of the same type, or a different type, in terms of composition or configuration. As a consequence, the membranes 120 may differ from each other, in terms of one or more of shape, permeance, permselectivity, or surface area available for permeation.

Furthermore, if an RO unit 110 includes a plurality of membranes 120, the membranes 120 may be arranged in series or in parallel, for example. The plurality of membranes 120 (if present) may be further operated in a "single-pass, single-stage" mode or a "single-pass, two-stage" mode. The term "single-pass, single-stage" mode means that the feed stream is passed through a plurality of individual membranes that are arranged in parallel. Thus, a feed stream is passed to each of the membranes, and a permeate stream and a retentate stream is removed from each of the membranes. The permeate streams are then combined to form a combined permeate stream. The term "single-pass, two-stage" mode means that the feed stream is fed to the first of two membranes that are arranged in series with the retentate from the first membrane being used as feed to the second membrane in the series. In some such instances, when the plurality of membranes 120 are arranged in series, the second feed stream 112 may be fed to the second surface of the second membrane, that is, on the final permeate discharge side.

As alluded to previously, the method includes feeding a first feed stream 111 to the first side 121 of the membrane 120, and feeding the second feed stream 112 to the second side 122 of the membrane. In some embodiments, the first stream 111 and the second feed stream 112 may be derived from a source stream 115 including seawater, aquifer water, river water, brackish water, water obtained from an oil bearing reservoir, synthetic saline water, or retentate stream 113. In certain embodiments, the first stream 111 and the second feed stream 112 may be derived a source stream 115 including seawater, as shown in FIG. 1.

The source stream 115 may be further subjected to one or more pre-treatment steps before being fed into RO unit 110. In some embodiments, as also shown in FIG. 1, the method includes feeding a source stream 115 to a pre-treatment unit 130, and generating a feed stream 116 from the pre-treatment unit 130.

The pre-treatment unit 130 may include any suitable filtration media adapted to filter the source stream 115 prior to being fed to the RO unit 110. Accordingly, any colloids, flocculants, particulates and high molecular mass soluble species and the like are retained by the filtration media by any suitable filtration mechanism. In some embodiments, the filtration media may include particulate material, such as sand, which may be of uniform size or may alternatively be graded. Alternatively, the pretreatment unit 130 may include one or more filtration membranes. In certain embodiments, the pre-treatment unit 130 may be selected from the group consisting of a microfiltration unit, an ultrafiltration unit, a nanofiltration unit, and combinations thereof.

In certain embodiments, the pre-treatment unit 130 may include at least one microfiltration unit, ultrafiltration unit, or combinations thereof. The pre-treatment unit 130 may be configured to remove at least a portion of the divalent cations from the source stream 115. Further, the pre-treatment unit 130 may be configured to remove sulfate ions from the source stream 115. In some embodiments, the source stream 115 may be further subjected to one or more of filtration steps to remove particulate matter, chlorine scavenging, dosing with a biocide, and scale inhibition, prior to feeding the source stream 115 to the pre-treatment unit 130.

In such instances, the feed stream 116 generated after the pre-treatment step is further split using an appropriate splitting mechanism 150 to generate the first feed stream 111 and the second feed stream 112. In some embodiments, the splitting mechanism may include a controller (for example, a flow splitter valve) configured to control the split of the feed stream 116 into the first feed stream 111 and the second feed stream 112. In such instances, the method may further include adjusting one or both of the flow rate and the pressure of the two feed streams 111,112, using the controller 150. In some instances, the controller 150 may include a flow controller configured to control the flow rates of the two feed streams 111,112. In some other instances, the control 150 may include a control valve configured to control both the flow rate and the pressure of both the feed streams 111,112.

Figure 3:
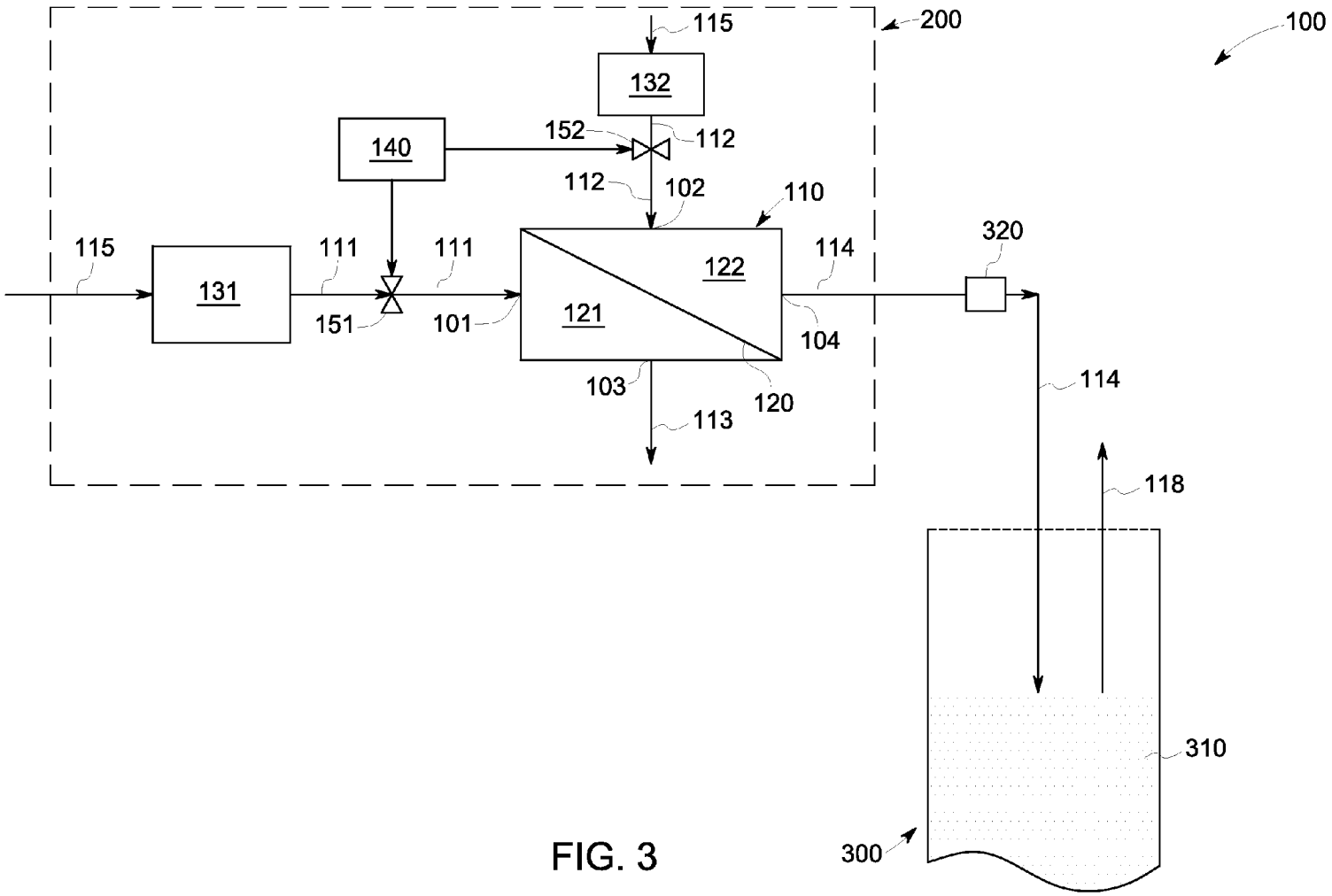
FIG. 3 illustrates a schematic of a system for recovering oil from an oil-bearing formation, according to an embodiment of the invention.

FIG. 3 illustrates an alternate embodiment in which the first feed stream 111 and the second feed stream 112 are generated using two separate pre-treatment units 131,132. The two pre-treatment units 131, 132 may be of the same or different type. In such instances the source stream 115 for the first pre-treatment unit 131 and the second pre-treatment unit 132 may be the same or different. Further, the first pre-treatment unit 131 and the second pre-treatment unit 132 may be independently selected from the group consisting of a micro-filtration unit, an ultra-filtration unit, a nano-filtration unit, and combinations thereof. Thus, by way of example, the first pre-treatment unit 131 may include a combination of ultrafiltration and microfiltration units, and the second pre-treatment unit 132 may include a microfiltration unit. In some other embodiments, both the first and second pre-treatment units 131, 132 may include a microfiltration unit.

In such instances, the method may further include adjusting one or both of the flow rate and the pressure of the first feed stream 111 using a first controller 151. The method may further include adjusting one or both of the flow rate and the pressure of the second feed stream 112 using a second controller 152. In some instances, the first controller 151 and the second controller 152 may include flow controller configured to control the flow rates of both the feed streams 111, 112. In some other instances, the first controller 151 and the second controller 152 may include a control valve configured to control both the flow rate and the pressure of the feed streams 111, 112.

According to embodiments of the invention, and as shown in FIGS. 1 and 3, the first feed stream 111, having a lower salinity content after passing through the membrane 120, is mixed with the second feed stream 112 on the permeate side of the membrane to form a product stream 114 having a controlled salinity content. The term "salinity content' as used herein refers to the amount of total dissolved salts in the water stream, that is typically measured using the units of parts per million (ppm) of total dissolved salts in water stream.

The mixing ratio (determined by the flow rate ratio) of the first feed stream 111 to the second feed stream 112 in the membrane 110 may depend on one or more of the first salinity content, the second salinity content, the dilution factor of the membrane 120, and the desired salinity content of product stream 114. The method may further include adjusting at least one of the first salinity content, the second salinity content, a flow rate of the first feed stream 111, and a flow rate of the second feed stream 112, to produce the product stream 114 having the controlled salinity content.

In some embodiments, the flow rates of the first feed stream 111 and the second feed stream 112 may be controlled in accordance with a measured variable. In some embodiments, the control may be automatic, and a feed-back control system may be employed. The measured variable may be a property of the injection water, for example, relating to the salinity (TDS content) of the injection water, or its conductivity. In some embodiments, a sensor (not shown) may determine the measured variable of the oil-bearing formation 300, and send a signal to the controller 150 to control the flow rates of the two streams 111, 112.

The first salinity and the second salinity content may depend, in part, on one or both of the salinity of the source stream 115 and the pre-treatment stages employed. In some embodiments, the first salinity content is in a range from about 10000 parts per million (ppm) to about 60000 pm. In some embodiments, the first salinity content is in a range from about 15000 parts per million (ppm) to about 50000 pm. In some embodiments, the first salinity content is in a range from about 25000 parts per million (ppm) to about 55000 ppm, for example, found at offshore locations. In some embodiments, the second salinity content is in a range from about 10000 parts per million (ppm) to about 60000 pm. In some embodiments, the second salinity content is in a range from about 15000 parts per million (ppm) to about 50000 pm. In some embodiments, the second salinity content is in a range from about 25000 parts per million (ppm) to about 55000 pm, for example, found at offshore locations.

In some embodiments, the ratio of flow rate of the feed stream 112 to the flow rate of the feed stream 111 may be in a range from about 0.01 to about 5. In some embodiments, the ratio of flow rate of the feed stream 112 to the flow rate of the feed stream 111 may be in a range from about 0.03 to about 3. In some embodiments, the ratio of flow rate of the feed stream 112 to the flow rate of the feed stream 111 may be in a range from about 0.02 to about 1.

The dilution factor of the RO unit 110 may also be adjusted to control the salinity content of the product stream 114. The term "dilution factor" as used herein refers to the ratio of the flow rate of the product stream 114 to the flow rate of the second feed stream 112. In some embodiments, the dilution factor in the RO unit 110 is in a range from about 1 to about 50. In some embodiments, the dilution factor in the RO unit 110 is in a range from about 1 to about 40.

The salinity content of the product stream 114 may further depend, at least in part, on the characteristics of the reservoir into which it is desired to inject the treated water. In some embodiments, the product stream 114 may have salinity sufficient to control formation damage, and a sufficiently low sulfate and multivalent cation concentration. In some embodiments, the controlled salinity content is in a range from about 500 ppm to about 30000 ppm. In some embodiments, the controlled salinity content is in a range from about 1000 ppm to about 25000 ppm.

The method further includes injecting at least a portion of the product stream 114 into the oil-bearing formation 300, and recovering at least a portion of the oil 310 from the oil-bearing formation 300, as shown in FIGS. 1 and 3.

Figure 2:
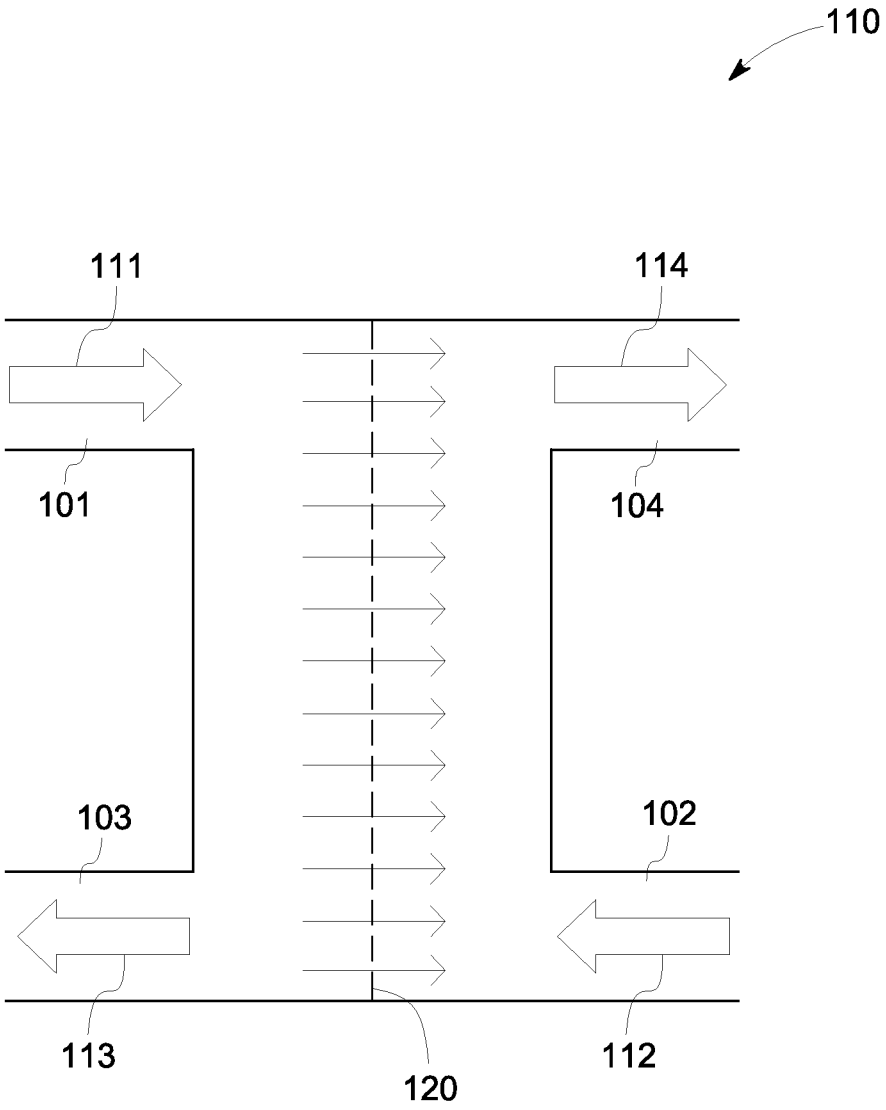
FIG. 2 illustrates a schematic of a reverse osmosis unit, according to an embodiment of the invention.

A system 100 for recovering oil from an oil-bearing formation 300 is also presented. The system 100, as shown in FIGS. 1 and 3, includes a desalination apparatus 200 for producing a product stream 114 with controlled salinity content. The desalination apparatus 200 includes at least one RO unit 110 as shown in FIG. 1. A schematic of the RO unit is further illustrated in FIG. 2. As shown in FIG. 2, the RO unit 110 includes at least one RO membrane 120. The RO unit 110 further includes a first inlet 101 configured to receive a first feed stream 111, having a first salinity content on a first side 121 of the membrane 120. The RO unit 110 further includes a second inlet 102 configured to receive a second feed stream 112 having a second salinity content on a second side 122 of the membrane 120 (FIG. 1).

The RO unit 110 includes a first discharge outlet 103 configured to discharge a retentate stream 113 from the first side 121 of the membrane 120. The RO unit 110 further includes a second discharge outlet 104 configured to discharge a product stream 114 having the controlled salinity content from the second side 122 of the membrane 120. As shown in FIG. 1, the second discharge outlet 104 is fluidly connected to an injection unit 320 that is configured to inject at least a portion of the product stream 114 to the oil-bearing formation 300.

As noted previously, in some embodiments, the desalination apparatus 200 may further include a pre-treatment unit 130 fluidly connected with the first inlet 101 and the second inlet 102 (FIG. 1). The pre-treatment unit 130 is configured to generate a feed stream 116 from the supply stream 115. The desalination apparatus 200 further includes a splitting mechanism 150 configured to split the feed stream 116 into the first feed stream 111 and the second feed stream 112 (FIG. 1). As mentioned previously, the splitting mechanism 150 may be configured to control a flow rate of the first feed stream 111 and the second feed stream 112. The pre-treatment unit 130 and the splitting mechanism 150 may have any suitable configuration, described hereinabove.

In some other embodiments, as shown in FIG. 3, the desalination apparatus 200 includes a first pre-treatment unit 131 fluidly connected with the first inlet 101, and a second pre-treatment unit 132 fluidly connected with the second inlet 102. The first pre-treatment unit 131 is configured to generate and supply the first feed stream 111 to the first inlet 101, and the second pre-treatment unit 132 is configured to generate and supply the second feed stream 112 to the second inlet 102. The desalination apparatus 200 in such instances may further include a first controller 151 and a second controller 152 to control the flow rates of the two feed streams 111, 112. The pre-treatment units 131, 132 and the controllers 151, 152 may have any suitable configuration, described hereinabove.

In accordance with embodiments of the invention, the two feed streams 111, 112 are mixed in the RO unit 120 itself, in contrast to typical water desalination systems, in which the high salinity stream is mixed downstream of the RO unit. Without being bound by any theory, it is believed that methods and systems of the present invention may provide for water injection stream having the desired controlled content, while reducing one or both of energy consumption and membrane area (therefore, lower footprint), when compared to the conventional desalination systems. Further, the second feed stream 112 on the permeate side of the membrane 120 may lead to a reduction in osmotic pressure difference across the membrane 120, and hence, superior performance.

The RO unit 110, in accordance with embodiments of the invention, operates using two 2 input feeds and generates 2 output streams (2-in-2-out), unlike most traditional reverse osmosis systems that operate using 1 input feed stream and 2 output streams. Forward osmosis (FO) is another osmosis system that works on the principle of 2-in-2-out configuration. However, as noted previously, an FO system uses a draw solute to artificially increase salinity on the permeate side, and thus requires a chemical system to remove the draw solute before sending out the permeate. In contrast, no such draw solute and extraction mechanism is required by the methods and systems, in accordance with embodiments of the present invention. Further, for sea water desalination, the FO process usually operates below a membrane differential pressure of 200 psi, while, the RO membranes in accordance with some embodiments of the invention, usually operate in the range of 400 psi to 1500 psi.

EXAMPLES

Example 1

Seawater Desalination for Hydro-Carbon Recovery

Assuming at a given location, the sea water salinity is 35,000 ppm and injection water salinity is 5000 ppm, a RO unit using a membrane having water permeability of $4\times10^{-5}$ $cm^3/cm^2$-sec-atm and salt permeability of $0.4\times10^{-5}$ cm/sec, would yield a product stream having a salinity of about 300 ppm. In a conventional system, this product stream may be blended downstream of the RO unit with sea water (having a salinity of 35,000 ppm) to provide an injection stream (having a salinity of about 5000 ppm) that can be injected into the hydro carbon reservoir. The blending ratio in this specific example would be 86% RO permeate and 14% sea water, to arrive at the 5000 ppm salinity. The net driving pressure (NDP) for a conventional system can be calculated using formula (I):

$$\text{NDP}=\text{Feed pressure}-\text{Average feed osmotic pressure}+\text{Permeate osmotic pressure} \quad \text{(I)}$$

The average feed osmotic pressure may be calculated by determining the average feed salinity (AFS) using formula (II):

$$AFS = Cf * \frac{\ln\left(\frac{1}{1-R}\right)}{R} = 35000 * \frac{\ln\left(\frac{1}{1-0.45}\right)}{0.45} = 46{,}498 \text{ ppm} \quad \text{(II)}$$

wherein R is recovery and is typically 45% and "Cf" is the sea water salinity (35000 ppm). Recovery is defined as the ratio of flow rate of permeate through the membrane to the flow rate of feed into the RO unit. Assuming a salinity of 1000 ppm corresponds to 11 psi osmotic pressure, the permeate osmotic pressure is negligible, and the feed pressure is 1000 psi, the NDP for a conventional system is calculated as:

$$\text{NDP(conventional)}=1000-46498\times11/1000=488 \text{ psi} \quad \text{(III)}$$

The net driving pressure (NDP) for a system, in accordance with some embodiments of the invention, can be calculated by determining average blended permeate salinity (BPS) using formula (IV):

$$BPS=5000\times\ln(1/(1-0.86))/0.86=11430\text{ ppm} \quad (IV)$$

Thus, the NDP for the present system, in accordance with some embodiments of the invention is calculated as:

$$NDP(\text{present system})=1000-46498*11/1000+11430*11/1000=613\text{ psi} \quad (V)$$

Thus, there is a 26% increase in NDP using the present system versus the conventional system. The increased NDP may produce higher product flow rate through the membrane, as shown in formula (VI):

$$Q=A*S*NDP \quad (VI),$$

wherein Q is permeate flow rate through the membrane; A is membrane permeability; and S is membrane area. Therefore, the membrane area S for a given product flow rate may be reduced (by 26% in this specific example), resulting in a smaller system than a conventional system. Alternatively, using the same membrane size as a conventional system, the energy consumption with the present system configuration may be reduced by 13%, in this specific example. Further, a combination of size savings and energy savings may also be realized, depending on the needs of the system.

The present invention has been described in terms of some specific embodiments. They are intended for illustration only, and should not be construed as being limiting in any way. Thus, it should be understood that modifications can be made thereto, which are within the scope of the invention and the appended claims. Furthermore, all of the patents, patent applications, articles, and texts which are mentioned above are incorporated herein by reference.

The invention claimed is:

1. A method for recovering oil from an oil-bearing formation, comprising:

(i) providing a reverse osmosis (RO) unit comprising at least one membrane having a first side and a second permeate side opposite the first side;

(ii) feeding a first feed stream having a first salinity content to the first side of the membrane;

(iii) feeding a second feed stream having a second salinity content to the second permeate side of the membrane wherein the first feed stream that passes through the membrane is mixed with the second feed stream on the second permeate side of the membrane to form a product stream;

(iv) discharging a retentate stream from the first side of the membrane;

(v) discharging the product stream having a controlled salinity content from the second permeate side of the membrane;

(vi) injecting at least a portion of the product stream into the oil-bearing formation; and recovering at least a portion of the oil from the oil-bearing formation.

2. The method of claim 1, further comprising adjusting at least one of the first salinity content, the second salinity content, a flow rate of the first feed stream, and a flow rate of the second feed stream, to produce the product stream having the controlled salinity content.

3. The method of claim 2, further comprising adjusting one or both of the flow rate of the first feed stream and the flow rate of the second feed stream by using a splitting mechanism configured to split a feed stream into the first feed stream and the second feed stream.

4. The method of claim 3, further comprising generating a feed stream from a pre-treatment unit and splitting the feed stream into the first feed stream and the second feed stream.

5. The method of claim 4, wherein the pre-treatment unit is selected from the group consisting of a micro-filtration unit, an ultra-filtration unit, a nano-filtration unit, a media filtration unit, and combinations thereof.

6. The method of claim 1, further comprising generating the first feed stream using a first pre-treatment unit and generating the second feed stream using a second pre-treatment unit.

7. The method of claim 6, wherein the first pre-treatment unit and the second pre-treatment unit are independently selected from the group consisting of a micro-filtration unit, an ultra-filtration unit, a nano-filtration unit, a media filtration unit, and combinations thereof.

8. The method of claim 1, wherein the first salinity content is in a range from about 10,000 parts per million (ppm) to about 60,000 ppm.

9. The method of claim 1, wherein the second salinity content is in a range from about 10,000 parts per million (ppm) to about 60,000 ppm.

10. The method of claim 1, wherein the controlled salinity content is in a range from about 500 ppm to about 30000 ppm.

11. The method of claim 1, wherein a dilution factor in the RO unit is in a range from about 1 to about 50.

12. A method for recovering oil from an oil-bearing formation, comprising:

(i) providing a reverse osmosis (RO) unit comprising at least one membrane having a first side and a second permeate side opposite the first side;

(ii) generating a feed stream from a pre-treatment unit and splitting the feed stream into a first feed stream having a first salinity content and a second feed stream having a second salinity content;

(iii) feeding the first feed stream to the first side of the membrane and feeding the second feed stream to the second permeate side of the membrane wherein the first feed stream that passes through the membrane is mixed with the second feed stream on the second permeate side of the membrane to form a product stream;

(iv) discharging a retentate stream from the first side of the membrane;

(v) discharging the product stream having a controlled salinity content from the second side of the membrane, wherein the salinity content of the product stream is controlled by adjusting one or both of the flow rate of the first feed stream and the flow rate of the second feed stream;

(vi) injecting at least a portion of the product stream into the oil-bearing formation; and (i) recovering at least a portion of the oil from the oil-bearing formation.

13. A system for recovering oil from an oil-bearing formation, comprising a desalination apparatus fro producing a product stream with a controlled salinity content, the desalination apparatus comprising at least one reverse osmosis (RO) unit, comprising:

(i) at least one RO membrane having a first side and a second permeate side opposite the first side;

(ii) a first inlet configured to receive a first feed stream having a first salinity content on the first side of the membrane;

(iii) a second inlet configured to receive a second feed stream having a second salinity content on the second permeate side of the membrane whereby the first feed stream that passes through the membrane is mixed with the second feed stream on the second permeate side of the membrane to form a product stream;

(iv) a first discharge outlet configured to discharge a retentate stream from the first side of the membrane; and (v) a second discharge outlet configured to discharge the product stream having the controlled salinity content from the second permeate side of the membrane, wherein the second discharge outlet is fluidly connected to an injection unit that is configured to inject at least a portion of the product stream to the oil-bearing formation.

14. The system of claim 13, further comprising a pre-treatment unit fluidly connected with the first inlet and the second inlet, wherein the pre-treatment unit is configured to supply the first feed stream to the first inlet and the second feed stream to the second inlet.

15. The system of claim 14, wherein the pre-treatment unit is configured to generate a feed stream, and wherein the desalination apparatus further comprises a splitting mechanism configured to split the feed stream into the first feed stream and the second feed stream.

16. The system of claim 15, wherein the splitting mechanism is configured to control a flow rate of the first feed stream and the second feed stream.

17. The system of claim 13, wherein the desalination apparatus further comprises a first pre-treatment unit fluidly connected with the first inlet, wherein the first pre-treatment unit is configured to generate and supply the first feed stream to the first inlet.

18. The system of claim 17, wherein the first pre-treatment unit is independently selected from the group consisting of a micro-filtration unit, an ultra-filtration unit, a nano-filtration unit, a media filtration unit, and combinations thereof.

19. The system of claim 13, wherein the desalination apparatus further comprises a second pre-treatment unit fluidly connected with the second inlet, wherein the second pre-treatment unit is configured to generate and supply the second feed stream to the second inlet.

20. The system of claim 19, wherein the second pre-treatment unit is independently selected from the group consisting of a micro-filtration unit, an ultra-filtration unit, a nano-filtration unit, and combinations thereof.

* * * * *